United States Patent [19]

Black

[11] Patent Number: 4,459,873

[45] Date of Patent: Jul. 17, 1984

[54] MARINE PROPULSION SYSTEM

[75] Inventor: James B. Black, Roscoe, Ill.

[73] Assignee: Twin Disc, Incorporated, Racine, Wis.

[21] Appl. No.: 350,734

[22] Filed: Feb. 22, 1982

[51] Int. Cl.[3] ..... F16H 47/00; F16H 47/08

[52] U.S. Cl. ..... 74/720; 74/688; 74/687; 440/75

[58] Field of Search ..... 74/687, 688, 705, 720, 74/720.5; 440/75

[56] References Cited

U.S. PATENT DOCUMENTS

| | | | |
|---|---|---|---|
| 2,749,776 | 6/1956 | Fischer et al. . | |
| 2,949,793 | 8/1960 | Suri | 74/720 |
| 3,180,180 | 4/1965 | Helfer et al. | 74/677 |
| 3,360,935 | 1/1968 | Schneider | 60/361 |
| 3,472,348 | 10/1969 | Hilpert . | |
| 3,500,704 | 3/1970 | Müller et al. | 74/688 |
| 3,631,953 | 1/1972 | Snoy et al. . | |
| 4,009,571 | 3/1977 | Black et al. | 60/354 |
| 4,012,908 | 3/1977 | Dundore | 60/354 |
| 4,068,747 | 1/1978 | Snoy . | |
| 4,242,925 | 1/1981 | Farkas . | |
| 4,245,520 | 1/1981 | Semar . | |
| 4,296,645 | 10/1981 | Jameson | 74/677 |
| 4,305,710 | 12/1981 | Schneider . | |

FOREIGN PATENT DOCUMENTS

| | | | |
|---|---|---|---|
| 1099641 | 9/1955 | France | 74/720 |
| 884562 | 12/1961 | United Kingdom | 74/688 |

*Primary Examiner*—Allan D. Herrmann
*Assistant Examiner*—D. Wright
*Attorney, Agent, or Firm*—James E. Nilles

[57] ABSTRACT

A propulsion transmission for a ship having a reversibly driven propeller shaft with a fixed pitch propeller and a torque converter of the single stage and fixed housing type for driving the propeller in the reverse direction. A planetary gear system is provided for driving the ship in a forward direction and a disengageable friction plate type brake is connected between the transmission housing and the planetary gear system and for forward drive. The brake is engaged to anchor a portion of the planetary gear system to drive said propeller shaft in a forward direction. The brake is disengaged when the torque converter is driving the propeller shaft in the reverse direction.

One embodiment of the invention also includes a friction plate type clutch connected between the planetary gear system and the propeller shaft for transmitting power to the propeller shaft in a forward direction when the brake is disengaged. The clutch and brake are concentrically located with respect to one another in an axially compact arrangement.

8 Claims, 11 Drawing Figures

REVERSE

FORWARD

REVERSE

HIGH SPEED FORWARD

LOW SPEED FORWARD

MARINE PROPULSION SYSTEM

BACKGROUND OF THE INVENTION

In prior art large marine transmissions requiring high horsepower efficiency and good heat absorption characteristics, the use of friction clutches for forward drive has been common. These transmissions were not always satisfactory due to flutter failure of the forward drive clutch when it was required to operate in reverse for reversing the direction of the ship or boat.

Prior art examples of attempts to overcome these flutter failure problems are shown in U.S. Pat. Nos. 4,068,747 of Jan. 17, 1978 to Snoy; 3,631,953 of Jan. 4, 1972 to Snoy; 3,472,348 of Oct. 14, 1969 to Hilpert; and also in my U.S. patent application Ser. No. 229,098, filed Jan. 28, 1981, all assigned to an assignee common with the present application.

The following prior art patents are examples of marine transmissions of this general character. The U.S. Pat. No. 4,242,925 to Farkas utilizes a brake to arrest the planet cage to thereby provide reverse and reduction, the sun gear being the input and the ring gear being the output. When the transmission operates in forward the brake is released and the plates will slip at engine speed. The present invention utilizes a planetary gear reduction for forward and a torque converter for reverse direction.

U.S. Pat. No. 4,245,520 to Semar utilizes a planetary gear train wherein the cage is permanently grounded thereby causing the ring gear to run in reverse direction and reduction mode continuously. The fluid coupling elements drive in opposite directions with the impeller at a speed lower than the runners. When the clutch is released and the fluid coupling is filled, the reverse output occurs. In the present application, when the drive is in forward, the clutch is engaged to drive the output at the input speed. The present torque converter operates at higher than input speed and is unlike a fluid coupling as to performance because a fluid coupling cannot multiply torque and its efficiency is proportional to its slip.

U.S. Pat. No. 2,749,776 to Fischer et al uses a transfer drive, two clutches for forward and reverse and also a bull gear. The bull gear has both external and internal teeth and is also a planetary gear set with the ring gear driving, and the cage braked stationary, and the sun gear is driven as part of the output. Fischer et al also has counter-rotating clutches when in either forward or reverse. Fischer's electromagnetic brake acts as a heat absorber during transition between forward and reverse or between reverse to forward.

U.S. Pat. No. 4,305,710 to Schneider assigned to an assignee common with the present invention utilizes numerous configurations using one or more hydraulic torque converters to stop and reverse the ship. A forward friction clutch is utilized to achieve high efficiency in the forward drive and the clutch then counter-rotates when the drive is in reverse. Several modifications of this patent utilize planetary gearing, in the reverse gear train to provide reverse rotation into the torque converter. The present application utilizes planetary gearing to obtain reduction in forward drive.

SUMMARY OF THE PRESENT INVENTION

The present invention provides a propulsion transmission for a ship having a reversibly driven propeller shaft with a fixed pitch propeller, a torque converter of the single stage and fixed housing type for driving the propeller in the reverse direction, a planetary gear system including planetary gears driven by a power input shaft and connected with the propeller shaft for driving it in a forward direction, a disengageable friction plate type brake connected between the transmission housing and the planetary gear system and being disengaged when the torque converter is driving the propeller shaft in the reverse direction, the brake being engaged to anchor a portion of the planetary gear system to permit said system to drive said propeller shaft in a forward direction.

A more specific aspect of the invention relates to a transmission of the above type including a friction plate type clutch which is disengageably connected between a planetary gear system and the propeller shaft for transmitting power to the propeller shaft in a forward direction when the clutch is engaged and the brake is disengaged. Still another more limited aspect of the invention relates to a transmission of the preceding type and which includes a second planetary gear system interposed between the propeller shaft and the transmission frame for reducing the speed of the propeller shaft as compared to the output of the first planetary gear system. The invention further provides a transmission of the foregoing type in which the clutch and brake are concentrically located with respect to one another and which results in an axially compact transmission.

DESCRIPTION OF PREFERRED EMBODIMENTS

Single Speed Transmission

FIGS. 1 to 5

Figure 1:
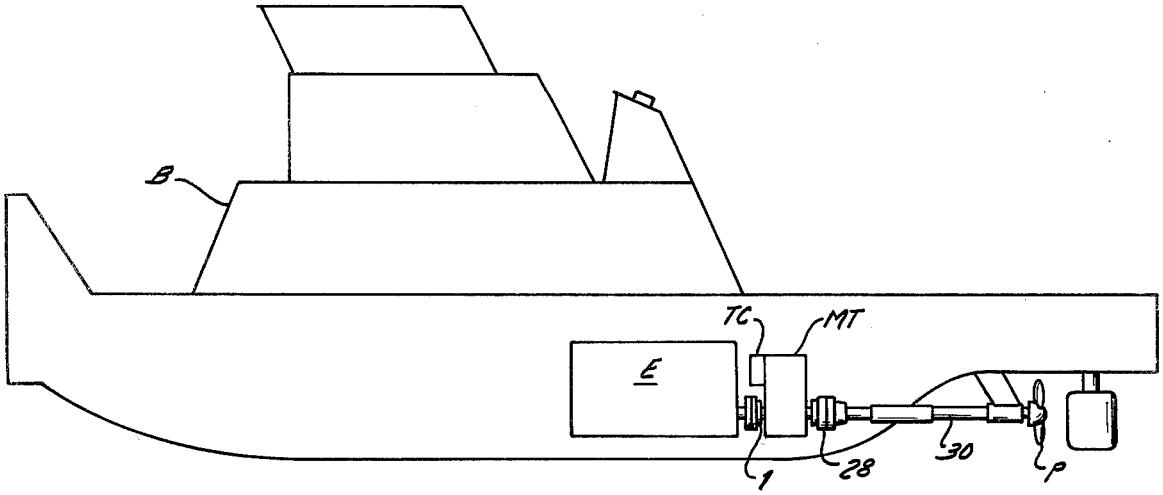
FIG. 1 is a schematic view of a river tow boat showing the transmission of the present invention applied thereto.

FIGS. 1 to 5 illustrate the invention as used in a single speed planetary marine reverse and reduction system and finds particular utility in ships, for example, river tow boats B or ocean tug supply ships, boats or the like. These craft have power plants of particularly large size where the horsepower and heat absorption demands suggest the use of a large friction type forward drive to accommodate heat absorption and which results in drive efficiency.

The river tow/push boat B has a marine transmission MT which is driven by a power source, such as a high horsepower engine E, for example, in the range of 2,500 to 8,000 horsepower. The engine E is connected by a flange coupling 1 to the transmission input power shaft 2 which is journalled in anti-friction bearings 3 and 4 in the transmission housing 5. The input shaft has a large gear 6 fixed therewith and also has a smaller sun gear 7 integrally formed therewith. The transmission also includes a layshaft 8 suitably journalled in the housing 5 in anti-friction bearings 8*a* and a small gear 9 is fixed to the shaft 8 at one end thereof and adjacent the bearings 8*a*. The other end of the shaft 8 is journalled in anti-friction bearings 10 in a fixed housing 11 of a torque converter TC.

The housing 11 of the torque converter TC is rigidly fixed to the housing 5 of the transmission and thus the torque converter is of the fixed, non-rotatable housing type. The torque converter TC is also of a single stage type and the particular characteristics of this torque converter are fully shown and described in the U.S. Pat. No. 4,305,710 issued Dec. 15, 1981 to Schneider. That patent explains the desirability of utilizing a torque converter of this type in a ship propulsion transmission having a fixed pitch propeller driven in reverse by the torque converter. The detailed construction of the torque converter and its operating characteristics are also shown in the U.S. Pat. No. 3,360,935 to Schneider issued Jan. 2, 1968; the U.S.Pat. No. 4,012,908 to Dundore of Mar. 23, 1977 and my U.S. Pat. No. 4,009,571 issued Mar. 7, 1977. All of the above patents have been assigned to an assignee common with the present invention.

The torque converter TC receives its power from input shaft 2 through gear means for example, through gear 6, a gear 14 in constant mesh with gear 6 and fixed on sleeve shaft 13 journalled in anti-friction bearing assemblies 15 and through sleeve 13. The converter impeller I is fixed to sleeve 13 and power is then transmitted through the toroidal path of the torque converter, namely through the fixed stators of the torque converter and to the turbine assembly T of the converter and then through the spline connection 12 at the end of shaft 8.

It should be noted that in this type of torque converter, the non-rotatable housing of the converter defines a radially outer bend 16 of the toroidal path of the converter, and the impeller and turbine are located on the outflow side of the toroidal path in the housing. The stator is fixed in the housing and precedes the impeller and is located at the inflow side of the toroidal path, the stator outlet radius being approximately the same as the impeller inlet radius. The torque converter has an operative and inoperative condition as will appear, that is to say it is operative when filled with fluid and is inoperative when the fluid has been dumped from the converter.

When the torque converter is operative, that is filled with fluid, power is transmitted from the large gear 6, through gear 14 and to sleeve 13, to drive the impeller I. Power is then transmitted through the turbine blade assembly T, through layshaft 8 and to the gear 9.

A gear connection is provided between layshaft 8 and a propeller shaft 24, as follows. A compound gear 19 is provided which includes a large gear 20, and a smaller gear 21 both of which are fixed on a shaft 22 that in turn is journalled in anti-friction bearings 23 in the housing of the transmission.

The propeller shaft 24 is journalled in anti-friction bearings 25 in the housing and has a radially extending flange 26 by means of which fore and aft thrust can be absorbed by the bearings 27 and 29 located adjacent either side of the flange 26. The outwardly extending end of the shaft 24 terminates in a flange 28 which can be coupled to the remainder of the propeller shaft 30 (FIG. 1) in the known manner. The inner end of the propeller shaft 24 has an externally toothed large gear 33 fixed therewith which is in constant mesh with gear 21.

Figure 5:
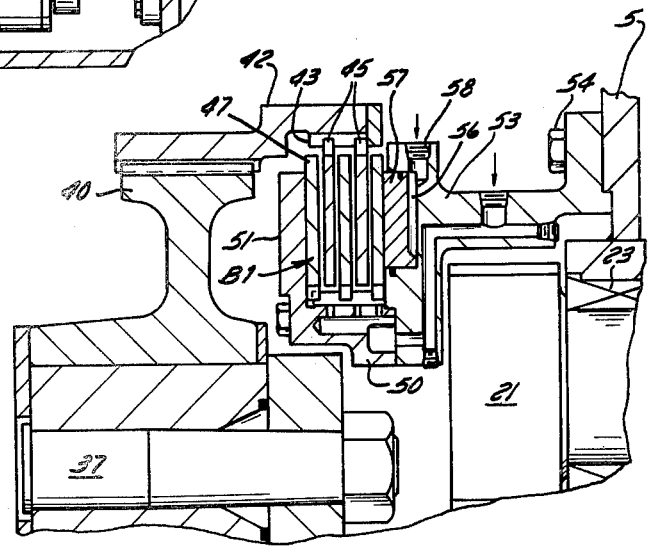
FIG. 5 is an enlarged, fragmentary sectional view of a portion of the transmission shown in FIG. 4, showing principally the brake.

A planetary gear system including planetary gears which are driven by the power input shaft 2, is connected with the propeller shaft 24 as follows. The inner end of propeller shaft 24 also has a large radially extending flange 35 to which is secured by overhanging shafts 37 a plurality of planetary gears 40. These planetary gears are in constant mesh with the sun gear 7 and are also in constant mesh with an internally toothed, large ring gear 42. The ring gear 42 also has internal splines 43 to which are secured the externally splined friction plates 45 of friction brake B. Internally toothed or splined plates 47 are interleaved in the known manner with plates 45 and are connected by their splines to the externally splined brake hub 50 (FIG. 5). The hub 50 also includes the back-up plate 51 against which the interleaved plates can be compressed. A piston housing 53 is fixed by bolts 54 to the transmission housing and defines an actuating chamber 56 in which the actuating piston 57 is slideably mounted in the known manner. Pressure fluid is admitted via passage 58 to the actuating chamber so as to urge the piston into clamping engagement with the interleaved plates to thereby engage the brake in the known manner.

Thus, a disengageable friction plate, hydraulically actuated brake $B^1$ is located between the transmission housing 5, where it is anchored, and a portion of the planetary gear system, more specifically the large internally toothed ring gear 42. Thus a portion of the planetary gear is anchored, that is, the gear 42 of the planetary system is prevented from rotating.

The brake $B^1$ is engaged when the marine transmission of the present invention is to be driven in the forward direction (FIG. 3), at which time the torque converter is in the empty, i.e., inoperative condition. Power flows from the engine, through shaft 2 and its sun gear 7, through the planetary gears 40, which are then rotatably driven against the fixed ring gear 42. The planetary gears rotate bodily around the large ring gear, thereby driving the propeller shaft 24 and consequently the propeller P in the forward direction.

When brake B is released and the unit is running through reverse drive, there are no counter-rotating frictional elements, and consequently, there is no clutch flutter as in prior art transmissions and which caused considerable problems and failure in such transmissions. Instead, the brake plates remain grounded to the transmission housing when the transmission is driven in forward direction.

The above transmission provides a single speed, planetary marine reverse and reduction gear in which a friction plate type brake is engaged for forward drive mode. In other words, the brake is engaged, thereby grounding the planetary ring gear and the sun gear 7 is driven to engine speeds. The planetary gear cage 35 is driven at a speed of $R \times S/(g+S)$ at for example a reduction of 5.021, where R is the input speed in rpm; S is the number of teeth of the sun gear and g is the number of teeth of the internal gear 42.

Figure 2:
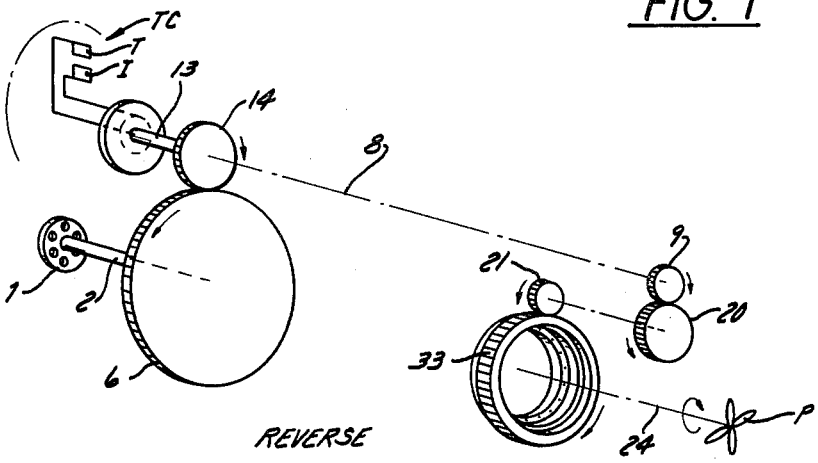
FIG. 2 is a schematic diagram of the transmission of the present invention and showing it when the torque converter is driving the propeller in the reverse direction.
Figure 3:
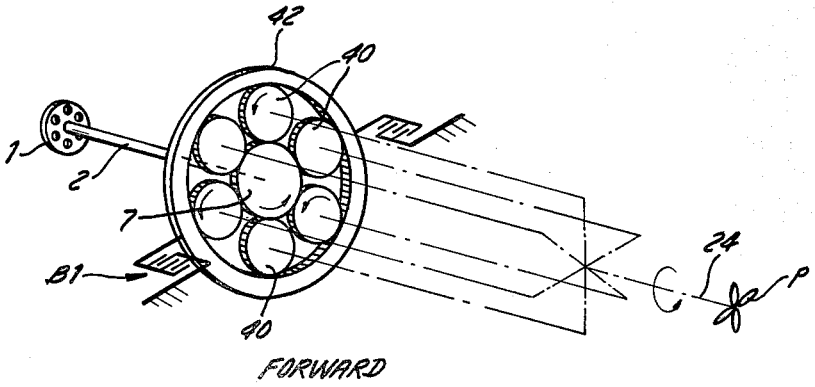
FIG. 3 is a view of the transmission shown in FIGS. 1 and 2 but when the brake is engaged and the transmission is driving the propeller in the forward direction.
Figure 4:
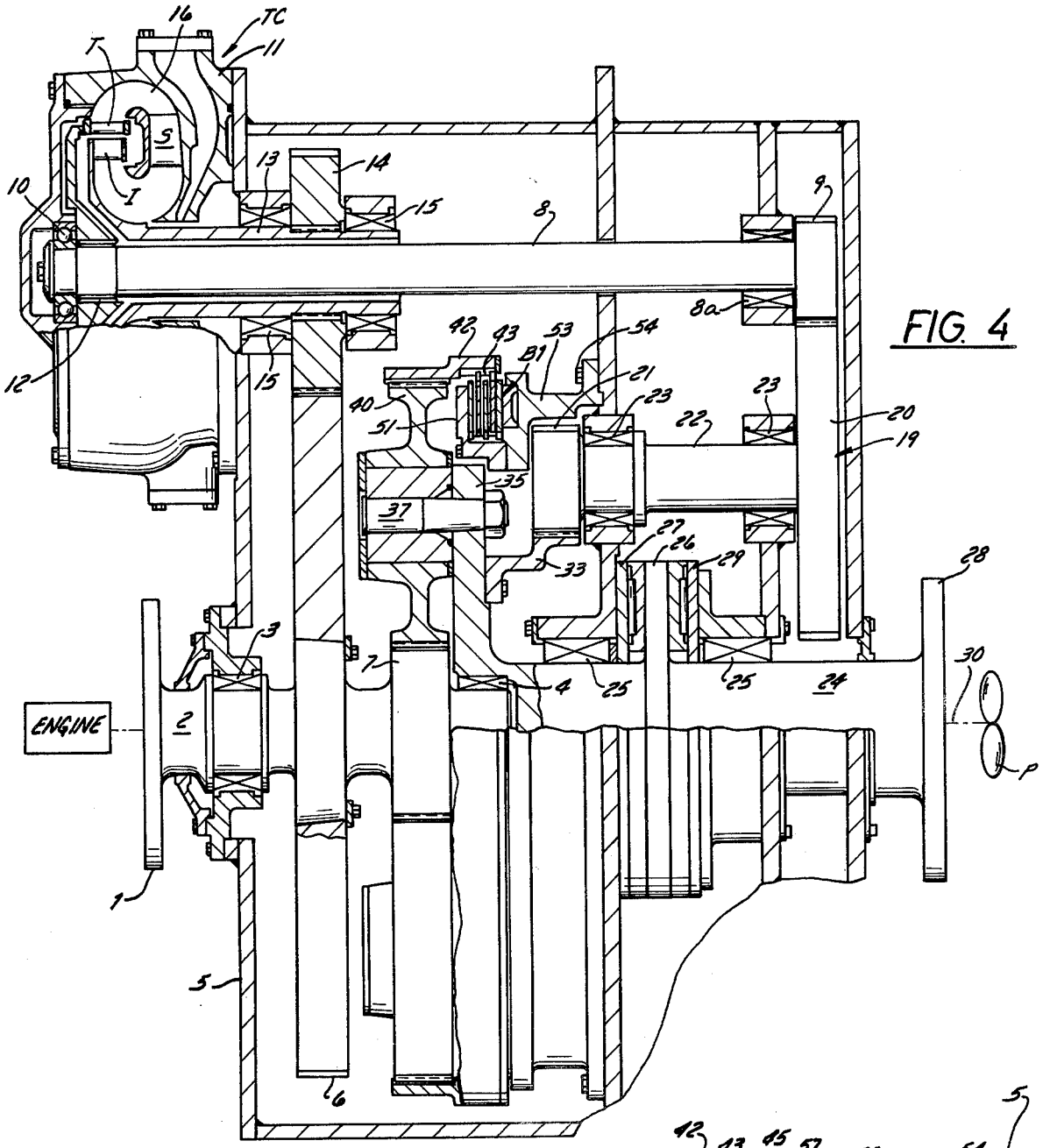
FIG. 4 is an enlarged elevational view of the transmission shown in FIGS. 1 to 3, in section, and with certain parts broken away for the sake of clarity.

The schematic representation of the transmission shown in FIG. 2 illustrates the reverse direction of drive to the propeller shaft, when the torque converter TC has been filled and is in the operative condition, and the brake B has been released. The power input to the torque converter is stepped up for example, tripled from engine speed, to minimize the size requirements of the torque converter, and the converter TC is sized to absorb full engine horsepower at reverse. The converter TC is also selected to provide peak efficiency of approximately 82 percent at a 0.070 speed ratio. The same propeller P that absorbs full propulsion horsepower in forward at 180 rpm will absorb 82 percent of full horsepower when running at 169 rpm in reverse. As shown in FIG. 2, power is transmitted from the engine to the large gear 6, through gear 14 and its sleeve 13, through the torque converter and out shaft 8 to drive the gear 9 fixed thereto. Power is then transmitted through the gears 20 and 21 and through the externally toothed gear 33 which is connected with and in effect forms part of the propeller shaft 24, thereby driving the propeller in reverse direction.

Two Speed Transmission

(FIGS. 6–11)

Figure 6:
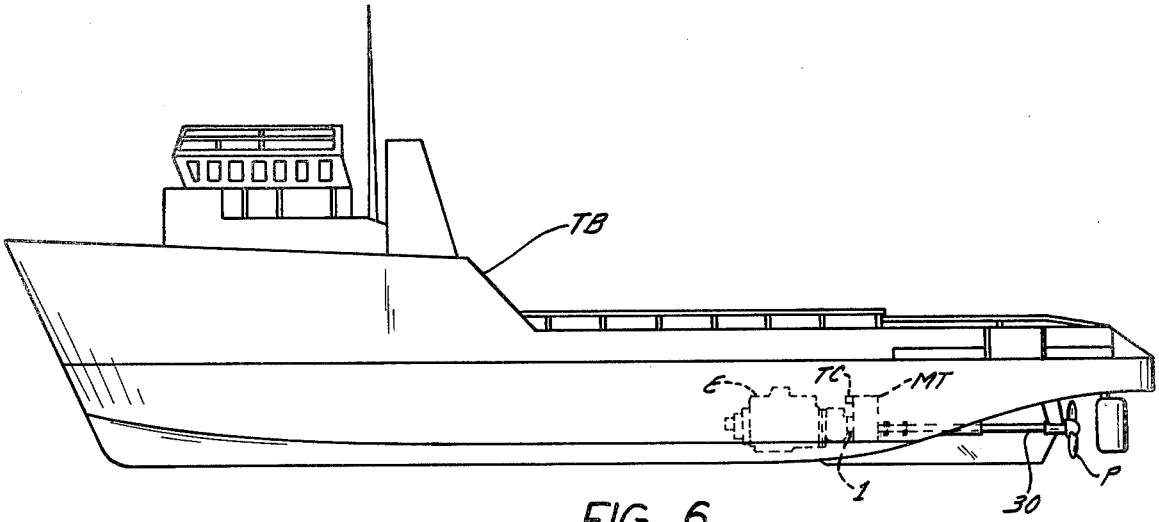
FIG. 6 is a schematic side elevational view of a two speed marine transmission as applied to a tug supply boat.
Figure 11:
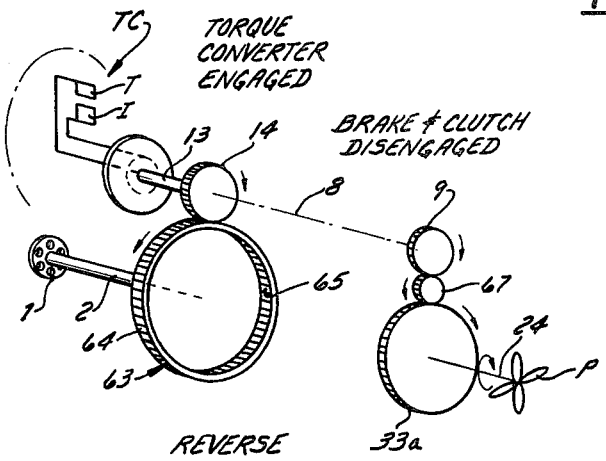
FIG. 11 is a schematic view of the FIG. 7 transmission when driving in the reverse direction and in which the torque converter is engaged or operative and both the brake and clutch are released or disengaged.

FIGS. 6 to 11 illustrate the invention in conjunction with a two speed marine transmission having two planetary gear systems and has been shown in FIG. 6 as applied to a tug supply boat TB which must absorb full engine horsepower while running slow but fully loaded such as when used in pushing tows or dragging nets. Such a boat must also be capable of running at a faster speed to and from jobs or when lightly loaded.

In this embodiment the high forward propeller speed may be 180 rpm as in the FIGS. 1 to 5 embodiment. However, it also provides an optional forward propeller speed, for example of 150 rpm. The reverse propeller speed for example is 150 rpm.

Parts shown in FIGS. 7 to 11 which are similar to corresponding parts in the FIGS. 1 to 5 modification, have similar reference numerals. For instance, the torque converter is of the same type shown in the FIGS. 1–5 embodiment.

In the two speed, two planetary gear system transmission shown in FIGS. 6 to 11, an initial planetary system 60 is provided in series with a final planetary gear system 61. The initial planetary system can be selectively engaged to provide two forward speeds.

Referring in greater detail to the transmission shown in FIGS. 6 to 11, the input shaft 2 drives the large gear 63 and this large gear 63 has an external gear 64 around its periphery and also has an internal gear 65. The external gear 64 is in constant mesh with gear 14 and, when reverse direction is desired, drives the torque converter TC as previously described. Power is taken from the torque converter through shaft 8 to the gear 9 which drives the idler gear 67. The idler gear 67 is in constant mesh with and drives the large gear **33*a* secured to an intermediate shaft 69 rotatably journalled at either end in anti-friction bearings in the housing. Thus the reverse operation is essentially the same as the single speed operation of the transmission of FIGS. 1–5**.

Initial Planetary Gear System

The initial planetary gear system 60 provides two forward speeds. This system includes a planetary gear cage 70 secured to intermediate shaft 69 and has a plurality of planet gears 71 rotatably mounted thereon by means of their respective overhanging shafts 72. Planet gears 71 are in constant mesh with and driven by the internal gear 65 of gear 63. Planet gears 71 are also in constant mesh with a sun gear 75 (FIGS. 7 & 8) which is journalled on the shaft 69.

This sun gear 75 has an over-hanging drum portion 77 to which are connected externally toothed friction clutch plates 79. Internally toothed friction clutch plates 80 are interleaved with clutch plates 79 and are fixed by their teeth to shaft 69. A fluid actuated piston 81, in chamber 82 in the radially enlarged portion 83 of shaft 69, acts to compress the plates 79 and 80 together to thereby clamp up the clutch C and form a driving connection between the planet gears 71 and shaft 69 to provide a low speed forward drive. This clutch C is engaged to lock the sun gear 75 with respect to the cage of the initial planetary gear system 60.

Figure 8:
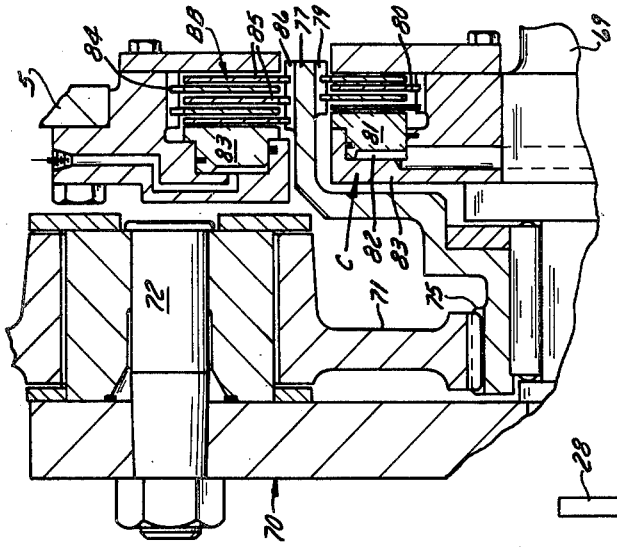
FIG. 8 is an enlarged, fragmentary view of a portion of the FIG. 7 showing, and showing the concentrically arranged brake and clutch.
Figure 7:
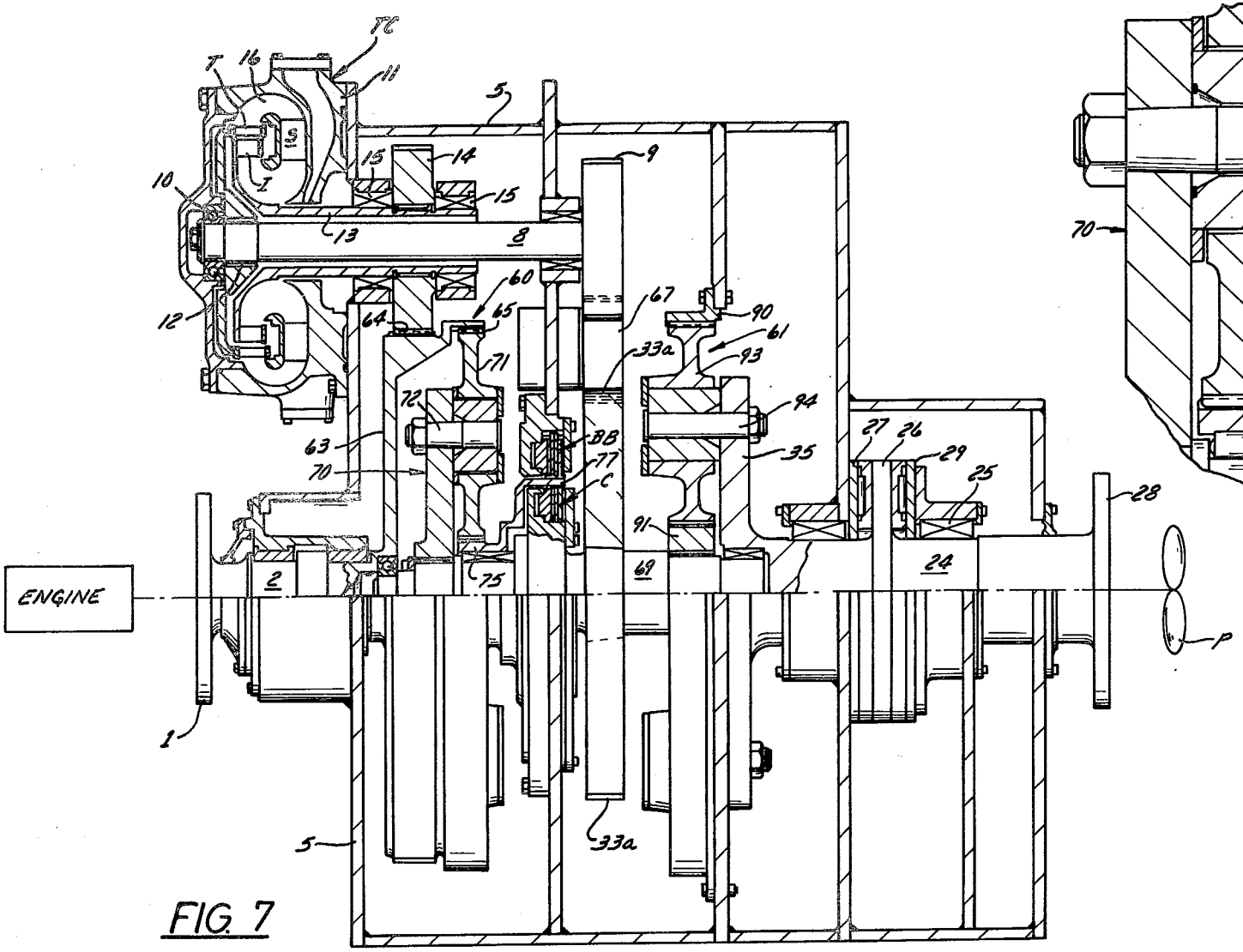
FIG. 7 is a side elevational view of the transmission shown in FIG. 6 and FIGS. 9, 10 and 11, but on an enlarged scale, the view being in section or with certain parts broken away for the sake of clarity.

A friction plate type brake BB is interposed between the frame 5 of the transmission and the sun gear 75. This brake also has interleaved friction plates as shown in FIG. 8 which are clamped up by the fluid actuated piston 83 in the known manner. More specifically, the externally toothed plates 84 are connected and anchored to the frame 5. Internally toothed plates 85 are splined at 86 to the periphery of the drum portion 77 of sun gear 75. Thereby, when the brake BB is engaged, the sun gear 75 is locked or grounded to the transmission frame, and a low propeller speed of about 150 rpm, for example, is provided. In this instance, the input drives the ring gear, the outer brake BB is engaged to thereby ground the sun gear and the cage 70 is driven.

The cage speed is again $R \times g/(g+S)$, with nomenclature as previously designated. The output speed is the input divided by $1.2 \times 5 - 6{:}1$ or a low output speed of 150 rpm, for 900 rpm input.

High propeller speed of 180 rpm is provided as follows. The clutch C is engaged, which serves to lock the sun gear 75 with respect to the cage 70, thus making the initial planetary system 60 inactive as a gear set. The entire initial planetary gear system then runs at input speed during which time the brake BB is disengaged.

By arranging the brake and the clutch in a concentric manner, a compact axial length of the overall design is provided.

Final Planetary Gear System

Figure 10:
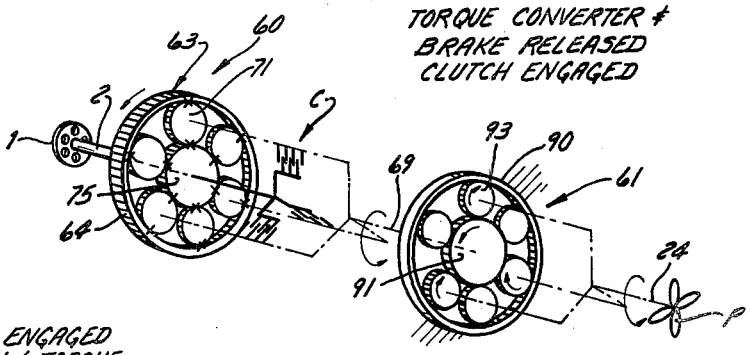
FIG. 10 is a schematic diagram of the FIG. 7 transmission when driving in the high speed forward direction and with the clutch engaged, the brake and torque converter being in the disengaged or inoperative position.
Figure 9:
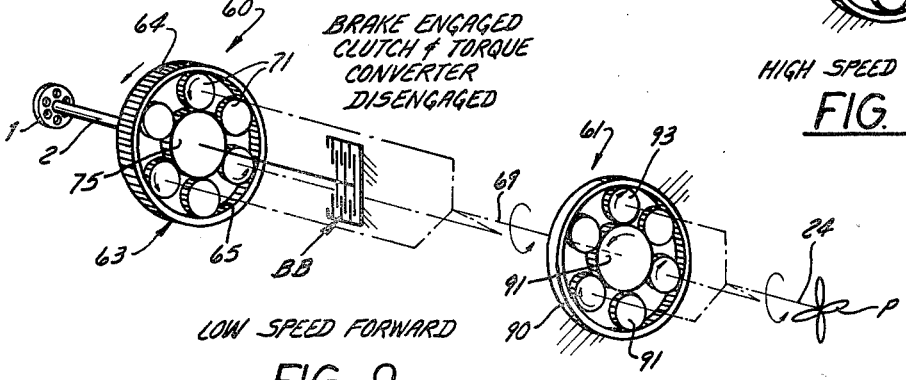
FIG. 9 is a schematic view of the FIG. 7 transmission when driving at low speed forward, the brake being engaged and the clutch and torque converter being disengaged or inoperative.

The final planetary gear system 61 operates in the same manner in both the low speed forward arrangement shown in FIG. 9 and the high speed forward arrangement shown in FIG. 10. In each case the outer ring gear 90 is permanently grounded or anchored by being fastened to the transmission frame 5. The sun gear 91 is secured to the rear end of intermediate shaft 69. The propeller shaft 24 has the radially extending flange or cage 35 to which is secured the plurality of planetary gears 93 by means of their over-hanging shafts 94. The planetary gears 93 are in constant mesh with internally toothed ring gear 90 and the sun gear 91 whereby the sun gear 91 drives the planetary gears 93 and also drives those gears bodily in their orbit because the gear 90 is anchored or grounded, consequently, the propeller shaft 24 is driven.

The final planetary gear system acts to reduce the speed between the output of the initial planetary gear system and the output of the propeller shaft. Otherwise, for example, when the transmission was operating as shown in FIG. 10, that is at high speed forward, the propeller would be turning at the rotational speed of the engine, which would be excessive.

I claim:

1. A marine propulsion transmission for a fixed pitch propeller, comprising, a transmission housing, a power input shaft, a reversibly driven propeller shaft and a layshaft journalled in said housing, a torque converter of the single stage and fixed housing type and having an operative and an inoperative condition and mounted on said layshaft for driving the latter, gear means connected between said power input shaft and said converter for driving said converter when the latter is in the operative condition, a gear connection between said layshaft and said propeller shaft whereby said converter directly drives said propeller shaft in a reverse direction when said converter is in said operative condition, a planetary gear system including planetary gears driven by said power input shaft, said planetary gear system being inoperative to transmit any power when said torque converter is in operative condition, said planetary gear system connected with said propeller shaft for driving the latter in a forward direction, a disengageable friction type brake connected between said housing and said planetary gear system, said brake being disengaged when said torque converter is in said operative condition and driving said propeller shaft in said reverse direction, said brake being engaged to thereby anchor a portion of said planetary gear system to said housing and to permit said planetary gear system to drive said propeller shaft in a forward direction.

2. The transmission set forth in claim 1 further characterized in that said planetary gear system includes a large ring gear within which said planetary gears may rotate, and said brake is connected between said ring gear and said housing to thereby anchor said ring gear to said housing when said brake is engaged.

3. The transmission set forth in claim 1 further characterized in that said planetary gear system includes a planetary gear carrier which is secured to said propeller shaft for rotation therewith, and wherein said gear connection includes a compound gear having a large gear and a small gear, said large gear meshing with a gear on said layshaft, and said small gear being connected with a gear secured to said propeller shaft.

4. The transmission set forth in claim 2 further characterized in that said planetary gear system includes a planetary gear carrier which is secured to said propeller shaft for rotation therewith, and wherein said gear connection includes a compound gear having a large gear and a small gear, said large gear meshing with a gear on said layshaft, and said small gear being connected with a gear secured to said propeller shaft.

5. The transmission set forth in claim 1 including a friction plate type clutch disengageably connected between said planetary gear system and said propeller shaft for driving said propeller shaft in a forward direction when said clutch is engaged and said brake is disengaged.

6. The transmission described in claim 5 including another planetary gear system interposed between said propeller shaft and said transmission frame for reducing the speed between the output of said first mentioned planetary gear system and the output of said propeller shaft.

7. The transmission set forth in claim 5 wherein said clutch is located radially within and concentric with said brake.

8. The transmission set forth in claim 1 further characterized in that said gear means which connects said power input shaft to said converter includes a large gear secured to said input shaft and also includes a small gear in constant mesh with said large gear, said torque converter including an impeller having a sleeve shaft fixed therewith, said small gear being secured to said sleeve shaft, and further characterized in that the large gear which is fixed to said input shaft also has an internal ring gear portion, and said planetary gears are in constant mesh with said ring gear portion.

* * * * *